US006097310A

United States Patent [19]

Harrell et al.

[11] Patent Number: 6,097,310

[45] Date of Patent: Aug. 1, 2000

[54] METHOD AND APPARATUS FOR MUD PULSE TELEMETRY IN UNDERBALANCED DRILLING SYSTEMS

[75] Inventors: John Harrell, Waxahachie; Andrew G. Brooks, Tomball; Hatem Salem Morsy, The Woodlands, all of Tex.

[73] Assignee: Baker Hughes Incorporated, Houston, Tex.

[21] Appl. No.: 09/227,785

[22] Filed: Jan. 8, 1999

Related U.S. Application Data

[60] Provisional application No. 60/073,512, Feb. 3, 1998.

[51] Int. Cl.[7] ..... G01V 1/40

[52] U.S. Cl. ..... 340/854.3; 367/85; 175/48

[58] Field of Search ..... 340/855.5, 854.3; 367/85, 83, 84; 175/48

[56] References Cited

U.S. PATENT DOCUMENTS

| | | | |
|---|---|---|---|
| 3,737,843 | 6/1973 | Le Peuvedic et al. | 367/85 |
| 4,078,620 | 3/1978 | Westlake et al. | 175/48 |
| 4,689,775 | 8/1987 | Scherbatskoy | 175/48 |
| 4,703,461 | 10/1987 | Kotlyar | 367/83 |
| 4,734,893 | 3/1988 | Claycomb | 367/85 |
| 5,079,750 | 1/1992 | Scherbatskoy | 367/85 |
| 5,150,333 | 9/1992 | Scherbatskoy | 367/83 |
| 5,201,375 | 4/1993 | Base et al. | 175/45 |
| 5,272,680 | 12/1993 | Stone | 367/85 |
| 5,787,052 | 7/1998 | Gardner et al. | 175/48 |

FOREIGN PATENT DOCUMENTS 2290320A 12/1995 United Kingdom .

*Primary Examiner*—Michael Horabik
*Assistant Examiner*—Albert K. Wong
*Attorney, Agent, or Firm*—Madan, Mossman & Sriram P.C.

[57] ABSTRACT

A mud pulse telemetry system uses a downhole pulser to produce sequences of positive and/or negative pulses according to a selected pattern. Positive pulses, negative pulses, and combinations thereof may be produced. A flow rate sensor at the surface measures changes in the flow rate at the top of the wellbore instead of or in addition to changes in the pressure. The flow rate changes are detectable even though the pressure pulses themselves may have a poor signal to noise ratio. This enables the invention to function effectively in underbalanced drilling wherein the use of light muds with a high gas content is required. One embodiment of the invention uses a conventional downhole pulser with the main valve closed and the pilot valve operating in a direct pulse mode.

24 Claims, 5 Drawing Sheets

METHOD AND APPARATUS FOR MUD PULSE TELEMETRY IN UNDERBALANCED DRILLING SYSTEMS

CROSS REFERENCES TO RELATED APPLICATIONS

This application claims priority from U.S. Provisional patent application Ser. No. 60/073,512 filed on Feb. 3, 1998.

FIELD OF THE INVENTION

The invention relates to transmission of information to and from downhole drilling equipment by a mud pulse telemetry system, and particularly to a mud pulse telemetry system for use in underbalanced drilling systems.

BACKGROUND OF THE INVENTION

In the process of drilling of wells into subsurface formations, it is common now to use "smart" motors at the end of the drillstring to adjust the rate and direction of drilling. Control of the motors is accomplished by means of signals from the surface. A number of known methods could be used for sending signals from the surface to a receiver at depth and vice-versa. This could be done by an acoustic signal carried by the mud or by the drillstring or it could be accomplished by an electromagnetic signal carried by the drillstring. These methods would be familiar to those versed in the art. However, these methods are difficult to use in continuing drilling operations because of the necessity of maintaining an adequate mud flow for drilling operations and of the noise associated with this and with the rotating drillstring. A common method of communicating the signals is by means of pressure pulses that alter the pressure of the drilling mud used in drilling operations. Prior art mud pulsing devices are generally classified in one of two categories. Either, the device generates positive pressure pulses or increases of pressure within the drill string over a defined basal level, or generates negative pressure pulses or decreases of the pressure for the drill string. U.S. Pat. No. 3,737,843, issued to Le Peuvedic, et al. is an example of a positive pulsing mud valve. A needle valve is mechanically coupled to a piston motor. The needle valve acts against a fixed seat. The piston motor in turn receives the continuous flow of control fluid. Information is transmitted to the surface in the form of rapid pressure variations ranging from 5 to 30 bars and succeeding one another at intervals of 1–30 seconds. Each pressure pulse is generated by reversing an electric current passing through a solenoid coil which is coupled to the needle valve.

Westlake, et al., (U.S. Pat. No. 4,780,620) shows a negative mud pulse system. A motor-driven valve is open in response to binary signals generated by a downhole sensor package. Upon opening the valve, portion of the mud flow is allowed to escape from the drill string to the annulus between the drill string and borehole.

Kotlyar (U.S. Pat. No. 4,703,461) discloses a device in which multistage mud pulsing is achieved by generating both positive and negative pulses within a drill string by means of a plurality of selectively operable bypass passages around a restriction to primary mud flow within a drill string or by venting to the outside of the drill string.

A major accompanying problem is that the signals get attenuated and dispersed as they propagate through the drilling mud. The attenuation and dispersion are unavoidable and are caused by various mechanisms, including viscous dissipation in the drilling mud as well as frictional energy loss at the borehole walls. The attenuation and dispersion of the signal becomes a particularly serious problem when underbalanced drilling mud is used to minimize reservoir damage. In normal drilling operations, or in drilling operations in geopressured formations where the risk of blowouts is high, the weight of the drilling mud is kept high enough so that the pressure of the mud exceeds hydrostatic pressure. In under-pressured reservoirs, use of heavy drilling mud could result in serious formation damage. Accordingly, drilling in such under-pressured reservoirs is carried out with underbalanced drilling muds that may contain nitrogen in the mud to reduce its density. The effect of the addition of nitrogen is to greatly increase the compressibility of the drilling mud: this reduces the bulk modulus and the velocity of propagation of the pulses in the drilling fluid. One result of an increased compressibility of the fluid is that a given pressure pulse at the source produces an increased flow pulse. In such a two-phase system consisting of a relatively incompressible liquid and a highly compressible gas, viscous dissipation greatly increases the attenuation and dispersion of mud pulse signals. For purposes of this application, any reference to a "compressible fluid" is intended to include a dissipative and attenuative fluid.

Another consequence of having a two-phase mixture of mud and a gas follows from the fact that the density and speed of propagation of sound in a gas (and a gas/liquid mixture) increases as the pressure is increased. When, as is typical in mud telemetry systems, the pressure pulses are comparable in magnitude to a "background"pressure, the trailing edge of a positive pulse may move faster than the leading edge. This greatly affects the shape of the pulse and complicates the process of pulse decoding.

SUMMARY OF THE INVENTION

The present invention is a method of and apparatus for improving the detectability of mud pulse telemetry signals in dissipative fluids (sometimes referred to as compressible fluids) used in underbalanced drilling by a modification to a conventional mud pulse telemetry method. The modification consists of measuring changes in the flow rate at the top of the wellbore instead of or in addition to changes in the pressure.

Another aspect of the invention relates to the location where the measurements are made. The surface equipment for a mud pulse telemetry system typically includes a pump and a pulsation dampener. Making measurements at the swivel or at the top of the Kelly, rather than immediately below the dampener, can give better results.

DETAILED DESCRIPTION OF THE INVENTION

Figure 1:
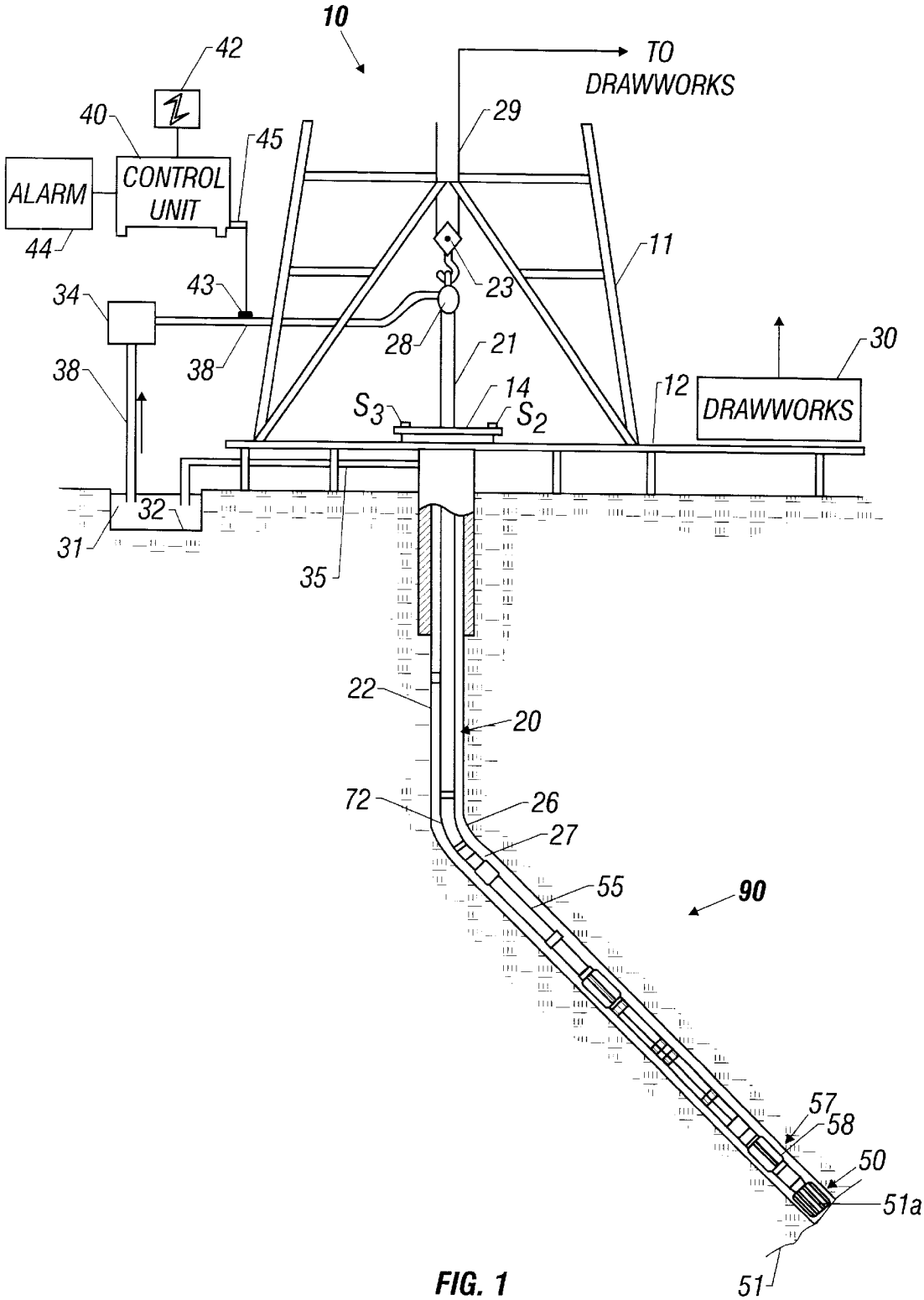
FIG. 1 illustrates a drilling arrangement using the present invention.

FIG. 1 shows a schematic diagram of a drilling system 10 having a drilling assembly 90 shown conveyed in a borehole 26 for drilling the wellbore. The drilling system 10 includes a conventional derrick 11 erected on a floor 12 which supports a rotary table 14 that is rotated by a prime mover such as an electric motor (not shown) at a desired rotational speed. The drill string 20 includes a drill pipe 22 extending downward from the rotary table into the borehole 26. The drill bit 50 attached to the end of the drill string breaks up the geological formations when it is rotated to drill the borehole 26. The drill string 20 is coupled to a drawworks 30 via a Kelly joint 21, swivel, 28 and line 29 through a pulley 23. During drilling operations, the drawworks 30 is operated to control the weight on bit, which is an important parameter that affects the rate of penetration. The operation of the drawworks is well known in the art and is thus not described in detail herein.

During drilling operations, a suitable drilling fluid 31 from a mud pit (source) 32 is circulated under pressure through the drill string by a "compressible-fluid surface system" 34. The details of the compressible fluid surface system 34 are discussed below with reference to FIG. 2. The drilling fluid passes from the fluid surface system 34 into the drill string 20 via a fluid line 38 and Kelly joint 21. The drilling fluid 31 is discharged at the borehole bottom 51 through an opening in the drill bit 50. The drilling fluid 31 circulates uphole through the annular space 27 between the drill string 20 and the borehole 26 and returns to the mud pit 32 via a return line 35. A surface torque sensor $S_2$ and a sensor $S_3$ associated with the drill string 20 respectively provide information about the torque and rotational speed of the drill string. Additionally, a sensor (not shown) associated with line 29 is used to provide the hook load of the drill string 20.

In one embodiment of the invention, the drill bit 50 is rotated by only rotating the drill pipe 52. In another embodiment of the invention, a downhole motor 55 (mud motor) is disposed in the drilling assembly 90 to rotate the drill bit 50 and the drill pipe 22 is rotated usually to supplement the rotational power, if required, and to effect changes in the drilling direction.

In one embodiment of the invention shown in FIG. 1, the mud motor 55 is coupled to the drill bit 50 via a drive shaft (not shown) disposed in a bearing assembly 57. The mud motor rotates the drill bit 50 when the drilling fluid 31 passes through the mud motor 55 under pressure. The bearing assembly 57 supports the radial and axial forces of the drill bit. A stabilizer 58 coupled to the bearing assembly 57 acts as a centralizer for the lowermost portion of the mud motor assembly.

In one embodiment of the invention, a drilling sensor module 59 is placed near the drill bit 50. The drilling sensor module contains sensors, circuitry and processing software and algorithms relating to the dynamic drilling parameters. Such parameters preferably include bit bounce, stick-slip of the drilling assembly, rotation, torque, shocks, borehole and annulus pressure, acceleration measurements and other measurements of the drill bit condition. The drilling sensor module processes the sensor information and encodes it into a pattern of pulses. These pulses could be positive pressure pulses, negative pressure pulses, or a combination of positive and negative pressure pulses. This pattern of pulses is transmitted to the surface control unit 40 using a telemetry pulser 72.

Those versed in the art would recognize that instead of a drillstring, as discussed above, drilling operations could also be carried out by a mud motor conveyed at the end of a coiled tubing, the mud motor driving a drill bit at the end of its drive shaft, with the operation of the mud motor being carried out by means of drilling fluid carried by the coiled tubing. The present invention includes such a system.

Figure 2:
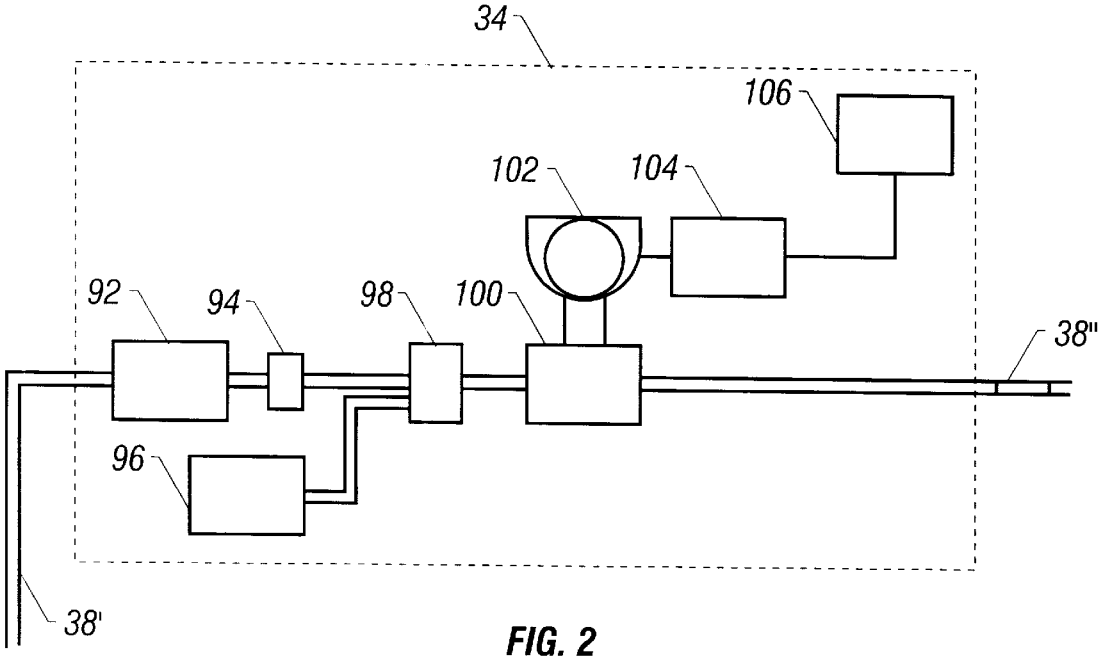
FIG. 2 shows the arrangement of the surface fluid system used in telemetry according to the present invention.

FIG. 2 shows the compressible fluid surface system used in telemetry. The compressible fluid surface system 34 includes a mud pump 92, a nitrogen generator 96 that acts as a source of gas, and an injection control device 98 that combines the nitrogen and the mud from the mud pit coming via the line 38'. Nitrogen is preferably used as a gas for reducing the density of the fluid in the borehole because it is relatively inert and readily available. The dual phase fluid coming out of the injection control device 98 is pumped via line 38" to the kelly joint 21. The fluid surface system 34 also includes a pulsation dampener 94, a venturi flow meter 100, a differential pressure transducer 102, a signal conditioner 104 and a conventional control and recording system 106.

The orifice flow meter 100 measures changes in the rate of flow of the mud through the line 38. Those versed in the art would recognize that pulses produced downhole by the pulser 72 would produce pressure changes in the line. Associated with these pressure changes are changes in the rate of flow of the two phase fluid in the line 38. In a conventional fluid surface system (not shown) used with incompressible, nondissipative fluids, a pressure transducer would be used at this point to detect the pressure pulses. These pressure pulses would then be sent to the surface system 106. In contrast, in the present invention, as noted above, a fluid flow meter is used. In order to be able to use this with the conventional surface system 106, the signal from the flow meter 100 is converted into a pressure signal by the differential pressure sensor 102 and suitably scaled by the signal conditioner 104 so that the resulting signal to the surface system 106 is comparable to the signal from a pressure sensing device in the line.

The embodiment of the invention described above uses an orifice flow meter. Other types of flow meters would be known to those versed in the art and could be used instead of an orifice flow meter. These types of flow meters include sonic, electromagnetic, turbine, venturi, temperature and coriolis flow meters. While these different types of flow meters are not specifically described here, any of these different types of flow meters could be used in the present invention without detracting from its effectiveness, and are intended to be within the scope of the present invention.

The coding of the pressure pulses corresponding to conditions of the measurement-while-drilling system and the decoding of the received signal would be familiar to those versed in the art and are not discussed here.

The pulsation dampener 94 is a gas-charged accumulator. The effect of the dampener on the detected signals is complicated due to the manner of operation of the dampeners. Its function is to absorb pressure surges generated by the mud pump 92. However, it is incapable of distinguishing between pressure surges from the mud pump and pressure pulses generated by the downhole pulser 72. When a positive pressure pulse arrives, the gas volume in the dampener 94 is reduced. This has the effect of taking up some of the fluid from the pump and reducing the flow rate proceeding downhole. The reduction in flow rate proceeding downhole is equivalent to a positive pressure pulse, so that the pulsation dampener tends to enhance the pulse as seen in the flow domain. On the other hand, a constant-flow pump acts as a "reflector" that enhances pressure pulses while diminishing velocity pulses. The surface geometry can therefore have a strong influence on the pulse shape. In the preferred embodiment of the invention, the monitoring of the pressure and flow is done near the kelly joint.

U.S. Pat. No. 4,742,498, issued to Barron, discloses a pilot operated mud pulse valve in which operation of a pilot valve causes a piston to move, causing a main valve to close and thereby create a pressure pulse. This patent, now expired, is incorporated in full by reference. The device in the patent forms the basis of the pulser used in one embodiment of the present invention.

Figure 2A:
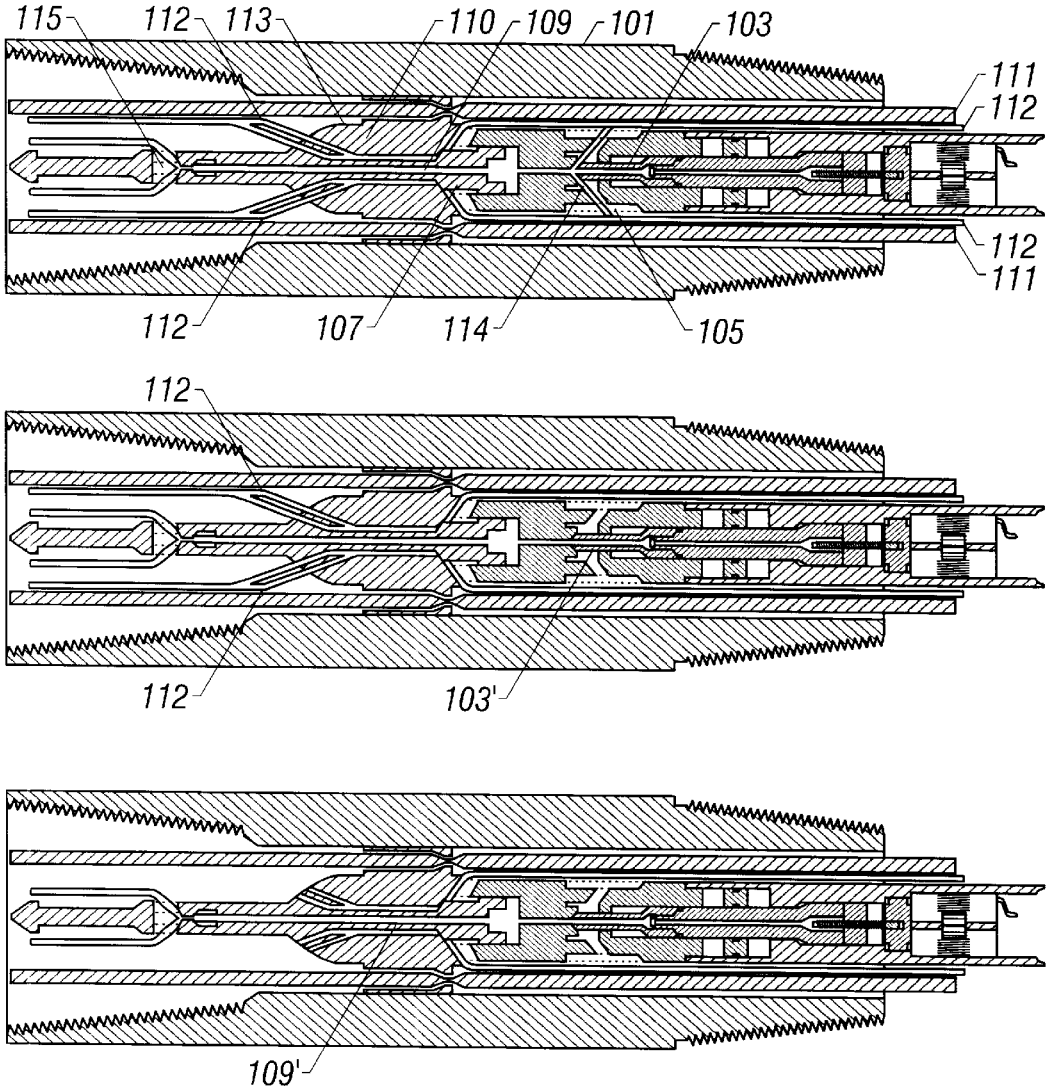
FIG. 2A shows a pulser according to the present invention

FIG. 2A illustrates the operation of a pilot operated mud pulse valve. The upper figure shows the configuration in the standby mode, the middle figure shows the pilot valve in the closed position and the bottom figure shows the main valve in the closed position. The actuator body 101 is connected to the fluid line (not shown). The main valve stem 109 is attached to the main valve base 107 and operates to close an opening in the main valve housing 110. A screen 115 is provided in the main valve. Also shown in the figure are the main valve fishing head 113 and the pilot valve housing 105. In typical arrangements, the pilot valve opening is 0.01 $in^2$.

Still referring to FIG. 2A, in the standby mode (upper figure), the pilot valve 103 and the main valve 109 are open. There are three components to the fluid flow: the bypass flow path, indicated by 111, the main valve flow path 112 and the pilot valve flow path 114 The main valve flow path allows fluid to enter the main valve on inlet ports (not shown) on the main valve fishing head 113, pass between the main valve stem 109 and the main valve bypass housing 110, and exit the bypass housing just above the main valve base 107. The inlet ports on the main valve fishing head 113 are at the same high pressure as the uphole side of the restrictor. The exit ports on the bypass housing 110 are at the same low pressure as the downhole side of the restrictor block. The pilot valve flow path 114 allow drilling fluid to pass through the main inlet valve screen 115, through the inside of the main valve stem 109 and the main valve base 107 and then exit into the area between the outside of the probe and the inside collar wall through exit ports (not shown) on the poppet valve housing 105. The pressure at the main inlet valve screen is the same as the high pressure in the fluid above the restrictor block. The pressure at the exit ports of the poppet valve housing 105 are at low pressure and the pressure drop is graduated from the inlet screen to the exit ports.

Movement of the pilot valve to the closed position, 103' results in the configuration shown in the middle figure, where the pilot valve fluid path 114 is absent. When the pilot valve 103 closes completely, fluid is no longer allowed to leave the exit ports of the poppet valve housing 105. The fluid directly behind the main valve base 107 increase to the inlet screen pressure which is a higher pressure than the fluid directly above the main valve base 107. This moves the main valve base forward until the main valve base comes in contact with the main valve seat.

Movement of the main valve to the closed position 109' results in the configuration shown in the bottom figure, with the main valve flow path 112 also absent. Once the main valve base stops the fluid flow, a positive pressure is created that travels inside the drillpipe.

When used with highly compressible and dissipative fluids, the hydraulically assisted main valve becomes inoperable. In the present invention, the pulser is modified so that the main valve remains closed at all times and the area of the pilot valve is increased from 0.01 $in^2$ to 0.1 $in^2$. The result is that the pilot valve becomes a direct drive pulser with adequate signal strength for compressible fluid operations.

Other types of pulsers can also be used in the invention. The device described above with reference to FIG. 2A produces positive pressure pulses by blocking a passage for the flow of fluid. Those versed in the art would recognize that other types of pulsers could also be used. For example, there are pulsers that produce negative pulses by opening up a passage for the flow of fluid. This type of pulser would produce a negative pressure pulse. Other pulsers open up a valve allowing downgoing fluid under pressure to drain directly into the returning fluid: this also creates a negative pulse. A pulser that produces both positive and negative pulses would rely on both types of operations, i.e., constricting a passage for the flow of fluid as well as opening up a passage for the flow of fluid. Pulsers of these different types and the pressure pulses produced by these different types of pulsers are intended to be within the scope of the present invention.

Those versed in the art would recognize that underbalanced drilling could also be carried out with dual-phase systems that have different components than mud and gas. For example, light-weight beads could be incorporated into the drilling mud. Yet another situation of underbalanced drilling would be drilling with just a gas, as is done in air drilling. Propagation of pressure pulses through such dual-phase systems or through a gas has characteristics similar to those discussed above with respect to the dual-phase system consisting of mud and gas, and the present invention is intended to include such systems.

Figure 3:
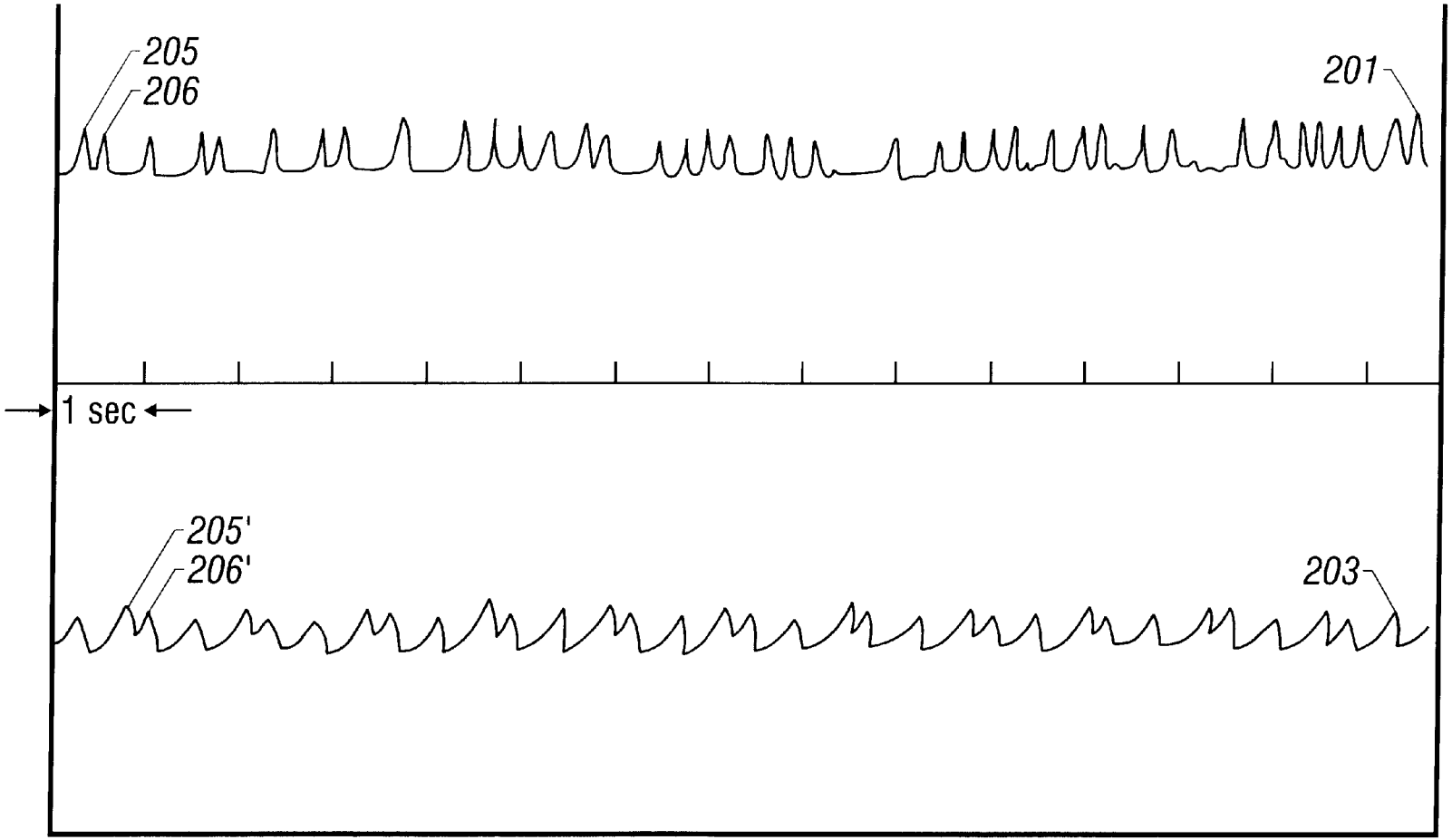
FIG. 3 shows a comparison between the received signal according to the present invention and a prior art pressure sensing arrangement.

FIG. 3 shows data gathered using the present invention in a well. The signal from the flow transducer 201 may be compared with the signal 203 from the pressure transducer. Indicated on the figure are timing marks that are one second apart. These data were recorded with the borehole fluid being water, essentially incompressible. For such an essentially incompressible fluid, there is no visual difference between the detectability of the signal from either sensor, i.e., a pulse telemetry system would not have problems decoding either set of signals. Visually, the signal from the flow sensor appears to be of higher frequency than the signal from the pressure sensor. In addition, comparison of the pair of pulses 205, 206 on the flow sensor with the corresponding pulses 205' and 206' shows that the signals from the flow sensor arrive ahead of the signals from the pressure sensor. However, this same relationship is not observed at later places in the wavetrains, so that the flow sensor signal is not simply the time derivative of the pressure signal. The actual wavetrains are complicated by reflections from the pump and the pulsation dampener.

Figure 4:
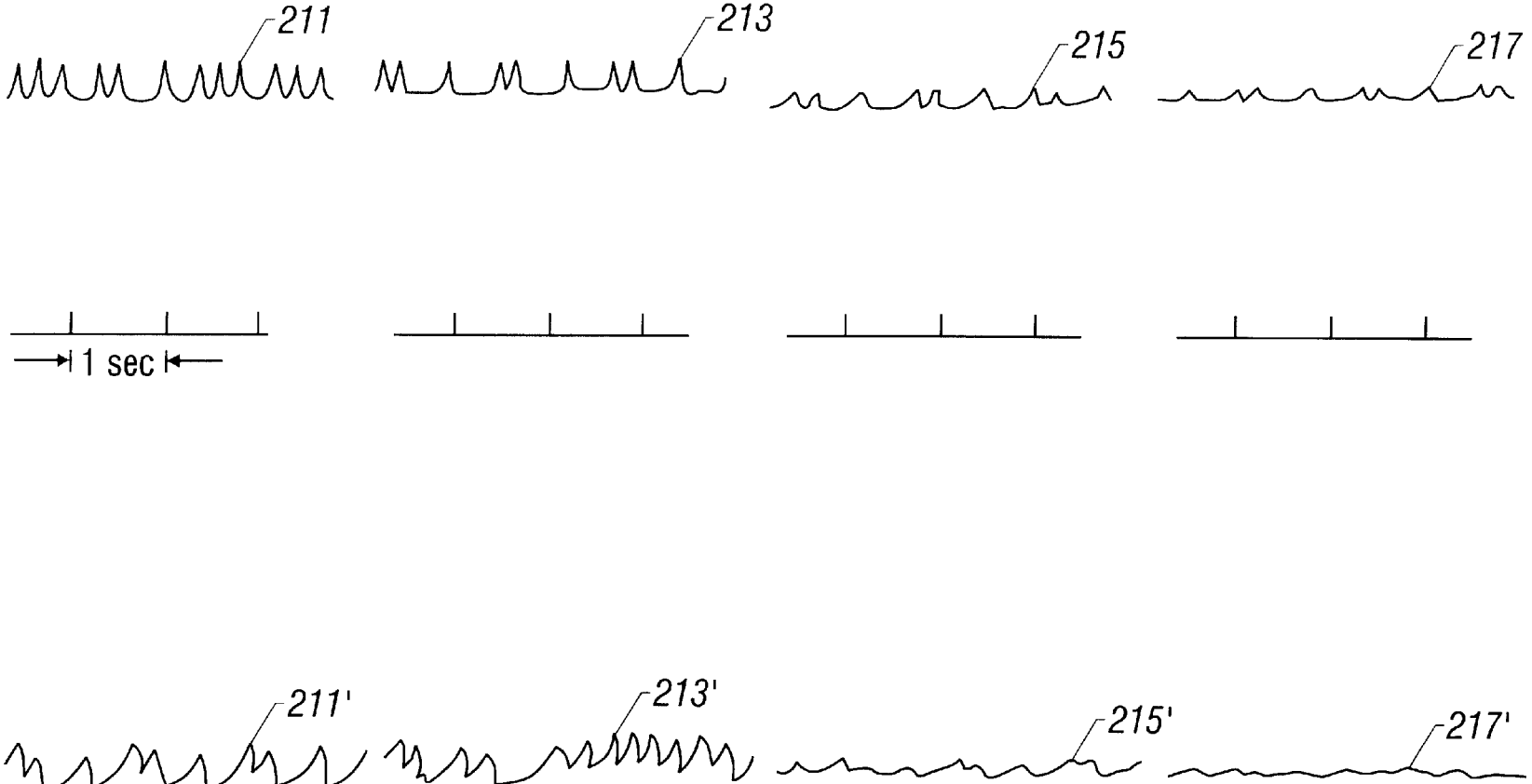
FIG. 4 shows the effect of increasing the amount of nitrogen in the fluid on the received signals.

FIG. 4 shows similar comparisons of signals from the flow sensor and the pressure sensor as the fluid composition is changed and nitrogen is added to the fluid using the injection control device 98. Curves 211 and 211' are measurements from the flow sensing transducer and the pressure transducer respectively when the borehole fluid has no nitrogen in it. The signals 213 and 213' are measurements from the flow sensing transducer and the pressure transducer respectively when the borehole fluid has 4% nitrogen added to it. Addition of nitrogen has the effect of increasing the compressibility of the borehole fluid and of increasing dissipation losses in the fluid. As can be seen, there is some deterioration in the quality of the signals from the two sensors with more degradation of the pressure transducer signal. In particular, in the zone indicated by 214, it is hard to identify the times of the individual pulses and the signal to noise ratio is much poorer.

The curves 215 and 215' are for 7% nitrogen in the fluid. The individual pulses in the fluid flow sensor are readily identifiable while their inception times are essentially undetectable with the pressure sensor. Finally, when the amount of nitrogen is increased to 18%, the fluid flow sensor signal 217 has an adequate signal to noise ratio while the signal 217' from pressure sensor shows no detectable signal.

The foregoing description has been limited to specific embodiments of this invention. It will be apparent, however, that variations and modifications may be made to the disclosed embodiments, with the attainment of some or all of the advantages of the invention. Therefore, it is the object of the appended claims to cover all such variations and modifications as come within the true spirit and scope of the invention

What is claimed is:

1. An underbalanced drilling system for use in drilling a wellbore having a fluid therein in a subsurface formation, the drilling system comprising:

(a) a fluid supply line supplying fluid under pressure to the wellbore while maintaining a pressure in the borehole fluid less than a formation fluid pressure;

(b) a pulser in the wellbore, said pulser generating positive pressure pulses in the wellbore fluid corresponding to a selected pattern;

(c) a flow rate sensor measuring fluid flow rate through said supply line corresponding to said pressure pulses and generating signals representative of the flow rate;

(d) a processor at the surface operatively coupled to said flow sensor, said processor determining from said flow sensor signals the selected pattern of pulses generated by said pulser.

2. The underbalanced drilling system of claim 1 wherein the drilling fluid is a single phase fluid.

3. The underbalanced drilling system of claim 1 wherein the drilling fluid is a dual phase fluid.

4. The underbalanced drilling system of claim 3 wherein the dual phase fluid is a mixture of a mud and a gas.

5. The underbalanced drilling system of claim 4 further comprising:

(i) a pump operatively connected to a source of the mud and to the fluid line for changing the pressure of the mud;

(ii) a source of the gas; and (iii) an injection control device connected to the pump and the source of the gas for combining the gas with the mud, said injection control device interposed between the pump and the downhole pulser.

6. The underbalanced drilling system of claim 5 wherein said flow meter is interposed between the injection control device and the pulser.

7. The underbalanced drilling system of claim 1 further comprising a differential pressure transducer coupled to the flow rate sensor, said differential transducer producing a pressure measurement in response to the rate of flow of the drilling fluid.

8. The underbalanced drilling system of claim 1 wherein the pulser further produces negative pressure pulses.

9. The underbalanced drilling system of claim 1 wherein the flow rate sensor is selected from the group consisting of: (i) an orifice flow meter, (ii) a sonic flow meter, (iii) an electromagnetic flow meter, (iv) a turbine, (v) a venturi flow meter, (vi) a temperature flow meter, and, (vii) a coriolis flow meter.

10. The underbalanced drilling system of claim 7 further comprising a signal conditioner interposed between the differential transducer and the processor said signal conditioner modifying the output of the differential transducer to a form suitable for the control and recording system.

11. The underbalanced drilling system of claim 1 wherein the pulser is conveyed on a tubular selected from the group consisting of (i) a drill string, and (ii) coiled tubing.

12. A telemetry system conveyed on a drilling tubular for use in an underbalanced Measurement-while-Drilling system for use in a borehole having a fluid therein, the telemetry system comprising:

(b) a pulser for generating positive pressure pulses in the borehole fluid corresponding to a selected pattern;

(c) a fluid supply line supplying fluid under pressure to the wellbore;

(d) a flow rate sensor measuring fluid flow rate through said supply line corresponding to said pressure pulses and generating signals representative of the flow rate; and (f) a processor at the surface operatively coupled to said flow sensor, said processor determining from said flow sensor signals the selected pattern of pulses generated by said pulser.

13. The telemetry system of claim 12 wherein the drilling fluid is a mixture of mud and gas, the surface assembly further comprising:

(i) a pump operatively connected to a source of the mud and to the fluid line for changing the pressure of the mud;

(ii) a source of the gas; and (iii) an injection control device connected to the pump and the source of the gas for combining the gas with the mud, said injection control device interposed between the pump and the downhole pulser.

14. The telemetry system of claim 12 further comprising a differential pressure transducer coupled to the flow rate sensor, said differential transducer producing a pressure measurement in response to the rate of flow of the drilling fluid.

15. The telemetry system of claim 12 wherein the tubular is selected from the group consisting of (i) a drill string, and (ii) coiled tubing.

16. The telemetry system of claim 12 wherein the pulser has a single valve operating in a direct drive mode.

17. The telemetry system of claim 12 wherein the pulser further produces negative pressure pulses.

18. The telemetry system of claim 12 wherein the flow rate sensor is selected from the group consisting of: (i) an orifice flow meter, (ii) a sonic flow meter, (iii) an electromagnetic flow meter, (iv) a turbine, (v) a venturi flow meter, (vi) a temperature flow meter, and, (vii) a coriolis flow meter.

19. A method of drilling a borehole in a subsurface formation comprising:

(a) conveying a bottom hole assembly on a drilling tubular into the borehole, (b) connecting a fluid line to communicate with a borehole fluid through the drilling tubular;

(c) providing a drilling fluid to the fluid line for maintaining an underbalanced condition wherein a pressure of the borehole fluid is less than a formation fluid pressure;

(d) operating a downhole pulser in the bottom hole assembly to generate positive pressure pulses in the borehole fluid corresponding to a selected pattern;

(e) measuring a rate of flow of fluid in the fluid line corresponding to said pressure pulses using a flow rate sensor and generating signals indicative of said rate of flow;

(f) processing said signals using a processor to determine the selected pattern; and (g) using a drill bit at an end of the bottom hole assembly to drill the borehole.

20. The method of claim 19 wherein the drilling fluid is selected from the group consisting of (i) a dual phase fluid, and (ii) a single phase fluid.

21. The method of claim 20 wherein the drilling fluid is a dual phase fluid and wherein maintaining an underbalanced condition further comprises:

(i) using a pump for pumping mud from a source thereof for changing the pressure of the mud;

(ii) combining the pressurized mud with gas from a source thereof in an injection control device to produce the dual phase fluid, said injection control device interposed between the pump and the downhole pulser.

22. The method of claim 19 further comprising using a differential pressure transducer coupled to the flow meter for producing a pressure measurement responsive to the rate of flow of the drilling fluid.

23. The method of claim 19 further comprising operating the pulser to produce negative pressure pulses.

24. The method of claim 19 wherein said flow sensor is interposed between the injection control device and the pulser.

* * * * *